United States Patent [19]

Sedam et al.

[11] Patent Number: 4,493,441

[45] Date of Patent: Jan. 15, 1985

[54] PORTABLE POST-MIX BEVERAGE DISPENSER UNIT

[75] Inventors: Jason K. Sedam, Dunwoody; Richard J. Mueller, Atlanta; Andrew J. Holoubek, Stone Mtn., all of Ga.

[73] Assignee: The Coca-Cola Company, Atlanta, Ga.

[21] Appl. No.: 320,478

[22] Filed: Nov. 12, 1981

[51] Int. Cl.[3] ..... B67D 1/00

[52] U.S. Cl. ..... 222/129.1; 222/130; 222/146.6; 62/390

[58] Field of Search ..... 222/129.1, 146 C, 173, 222/182, 129.3, 129.4, 129.2, 130; 62/390, 306

[56] References Cited

U.S. PATENT DOCUMENTS

| | | | |
|---|---|---|---|
| 2,681,549 | 6/1954 | Maxwell | 222/146 C X |
| 2,750,076 | 6/1956 | Welty et al. | 22/129.1 |
| 2,978,143 | 4/1961 | Arnett et al. | 222/129.1 X |
| 3,139,219 | 6/1964 | Gran | 62/390 X |
| 3,195,779 | 7/1965 | Nicko | 222/129.1 X |
| 3,266,672 | 8/1966 | Dean | 62/390 X |
| 3,280,591 | 10/1966 | Webster | 62/390 |
| 3,312,083 | 4/1967 | Scoggins et al. | 62/390 |
| 3,343,726 | 9/1967 | Johanningmeier | 222/129.1 |
| 3,572,054 | 3/1971 | Curcio | 62/390 |
| 4,008,832 | 2/1977 | Rodth | 222/146 C |
| 4,009,593 | 3/1977 | Davis | 222/146 C X |
| 4,272,968 | 6/1981 | Harvill | 62/390 X |
| 4,306,667 | 12/1981 | Sedam et al. | 222/146 C |

FOREIGN PATENT DOCUMENTS

| | | |
|---|---|---|
| 22589 | 1/1981 | European Pat. Off. . |
| 27880 | 5/1981 | European Pat. Off. . |

*Primary Examiner*—Joseph J. Rolla
*Assistant Examiner*—Frederick R. Handren
*Attorney, Agent, or Firm*—Birch, Stewart, Kolasch & Birch

[57] ABSTRACT

A lightweight, portable post-mix carbonated beverage dispenser unit for use in small offices or small-volume locations is described. Flavored syrup is supplied to the unit from disposable sealed syrup packages which are plugged into a dispenser valving system. $CO_2$ is supplied to the unit carbonator system in returnable containers which also may be quickly plugged into a $CO_2$ valving system. A thermoelectric refrigeration system may be provided to decrease noise and the number of moving parts or a mechanical freon system may be used. The unit construction may be modular for ease of repair. The cabinet is injection-molded from plastic. Water is supplied to the unit for mixing with the $CO_2$ and syrup from a water reservoir which may be manually filled. The refrigeration system cools the water in the reservoir, as well as the syrup packages and carbonator tank.

10 Claims, 13 Drawing Figures

PORTABLE POST-MIX BEVERAGE DISPENSER UNIT

BACKGROUND OF THE INVENTION

The present invention relates to post-mix beverage dispensers which are compact, portable and suitable for use in small offices or small volume locations. More specifically, the present invention relates to a compact post-mix beverage dispenser unit which may be disposed on a counter top in the above-mentioned environments and supplied with water from a pitcher, syrup from disposable sealed packages and $CO_2$ for carbonation from refillable containers in a rapid and efficient manner. An accessory attachment may allow connection to a building water supply for automatic refill of the reservoir.

Heretofore, the majority of commercially-available post-mix beverage dispenser units have been designed for large volume commercial uses such as in fast food restaurants. Because of these large volume uses, design criteria have emphasized optimum cooling and dispenser speed rather than low unit cost, size and portability. Although some consideration has been given to cost, size and portability even in these large volume commercial units, the resulting unit designs are generally far too expensive, bulky and heavy for small volume use.

Some attempts have been made in the beverage dispenser industry to reduce the cost, size and weight of these units to make them available for use by the general public. However, the units designed heretofore have lacked sufficient cooling capacity, dispensing efficiency, beverage quality and reliability as a trade off to achieving the aforementioned low cost, size and portability needed for consumer acceptance.

In order to be accepted by the small volume consumer, post-mix dispenser units must be easy to set up for use, compact, lightweight, easily repaired, reliable and, most importantly, inexpensive. In addition, the syrup, water and $CO_2$ supplies must be quickly and easily replenished during use by an unskilled consumer. Although attempts have been made to design post-mix beverage dispenser units possessing the foregoing criteria, the design of such a unit has not been totally achieved prior to the invention described hereinafter.

SUMMARY OF THE INVENTION

Accordingly, it is a primary object of the present invention to provide a portable, low cost, miniature post-mix beverage dispenser unit suitable for use in small offices or low volume locations.

It is a further object of the present invention to provide a post-mix beverage dispenser unit with cabinetry features which facilitate rapid set-up, loading and replenishing of the syrup, water and $CO_2$ to be used in making the beverages.

It is another object of the present invention to provide a heat transfer circuit in a post-mix beverage unit operatively associated with a mechanical refrigeration system which directly contacts and cools the water, carbonator tank and syrup packages contained in the unit.

It is still a further object of one embodiment of the present invention to provide an alternative thermoelectric cooling system which is reliable, compact, adaptable to world electrical requirements, quiet and lightweight, consistent with the objectives of an improved portable post-mix beverage dispenser unit.

The objects of the present invention are fulfilled by providing a post-mix beverage dispenser unit comprising: a post-mix beverage dispenser system having a water supply, a carbonator tank, at least one syrup container, a $CO_2$ pressure regulator valve assembly and a beverage dispenser valve assembly, the improvement comprising first socket means in said $CO_2$ pressure regulator valve assembly for receiving and supporting the discharge end of said $CO_2$ cylinder, said discharge end being at the bottom of said container when said container is disposed in said first socket means; and second socket means in said beverage dispenser valve assembly for receiving and supporting a discharge end of said syrup container, said discharge end of said syrup container being at the bottom of said container when said container is disposed in said second socket means, whereby said at least one syrup container and said at least one $CO_2$ cylinder can be rapidly plugged into said first and second socket means.

The dispenser unit in a preferred embodiment is adapted for rapid set-up by providing a unique cabinet construction comprising: a main cabinet portion having front, back, side and bottom walls with open compartments formed therein for housing various components of the post-mix beverage dispenser, said compartments including a water supply compartment for housing a water reservoir adjacent said back wall and an entrance chute therefor adjacent said front wall, a carbonator compartment for housing a carbonator tank adjacent said back wall, a syrup supply compartment for for housing replaceable syrup containers adjacent said front wall, and a $CO_2$ cylinder adjacent said front wall; said top wall of said main cabinet having openings therein providing access to said water reservoir, entrance chute, carbonator compartment, and said syrup supply compartment; said front wall having openings therein providing access to said syrup supply compartment and said $CO_2$ supply compartment; first access panel means normally covering the openings in said top wall providing access to both said entrance chute of said water compartment and said syrup compartment, and the opening in said front wall providing access to said syrup supply compartment, said first access panel means being movable to selectively uncover said entrance chute and said syrup supply compartment; a second removable access panel normally covering said openings in said top wall providing access to said water compartment and said carbonator compartment; and a third access panel means normally covering the opening in said front wall providing access to said $CO_2$ supply compartment, said third access panel means being movable to uncover said opening in said front wall to provide access to said $CO_2$ supply compartment.

As an alternative, an accessory attachment may allow connection to a building water supply for automatic refill of the reservoir.

BRIEF DESCRIPTION OF THE DRAWINGS

The objects of the present invention and the attendant advantages thereof become more readily apparent by reference to the accompanying drawings, wherein.

DETAILED DESCRIPTION OF THE PREFERRED EMBODIMENTS

Cabinetry Construction and General Component Arrangement

Figure 1:
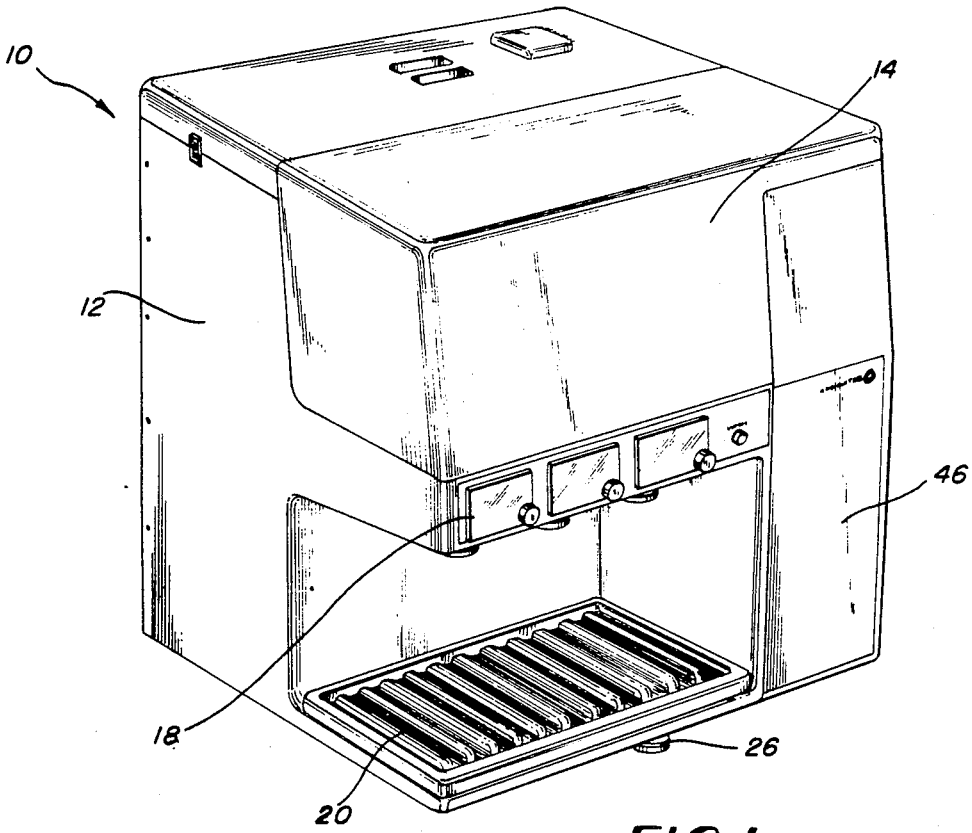
FIG. 1 is a front elevational view of the post-mix beverage dispenser unit of the present invention.
Figure 2:
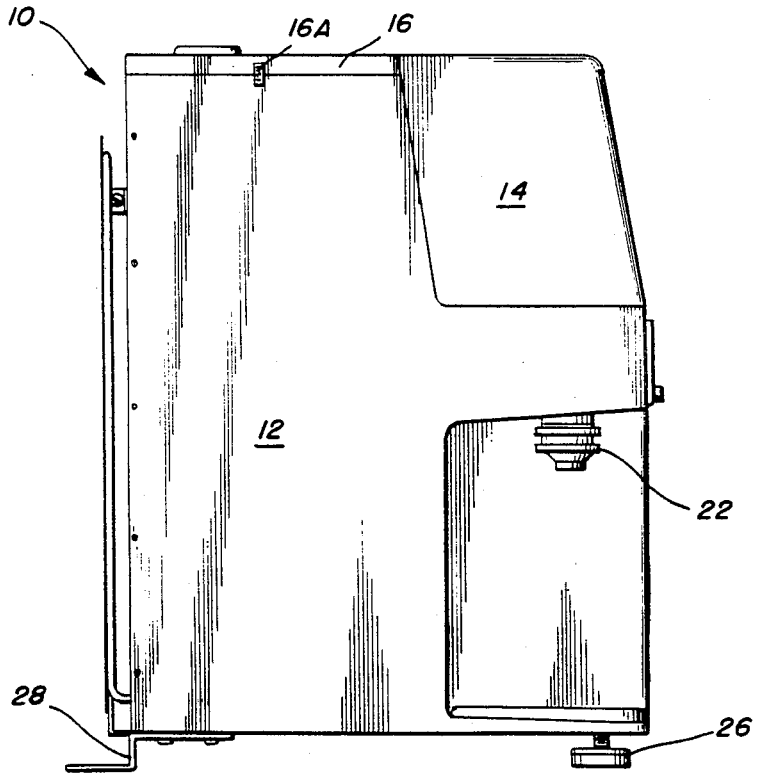
FIG. 2 is a left-side elevational view of the post-mix beverage dispenser unit of FIG. 1.
Figure 3:
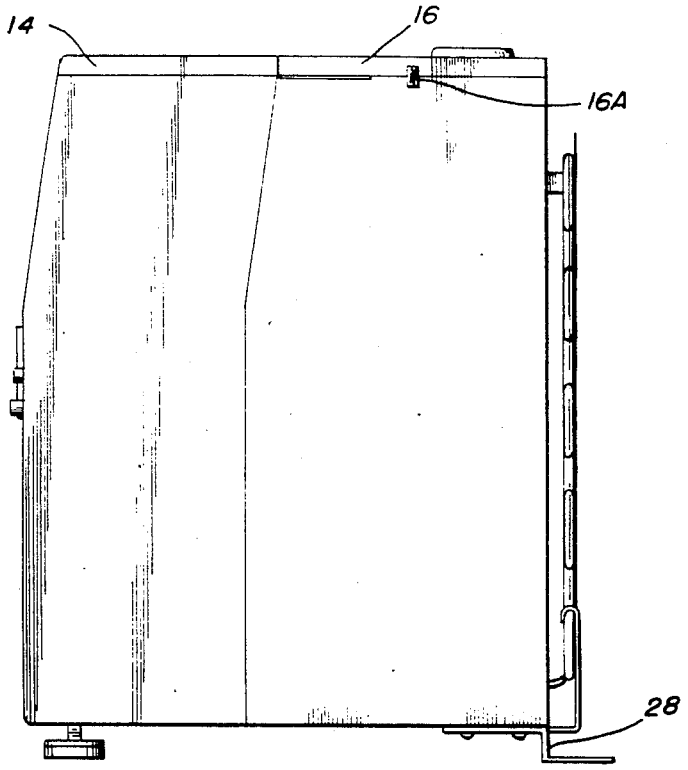
FIG. 3 is a right-side elevational view of the post-mix beverage dispenser unit of FIG. 1.
Figure 4:
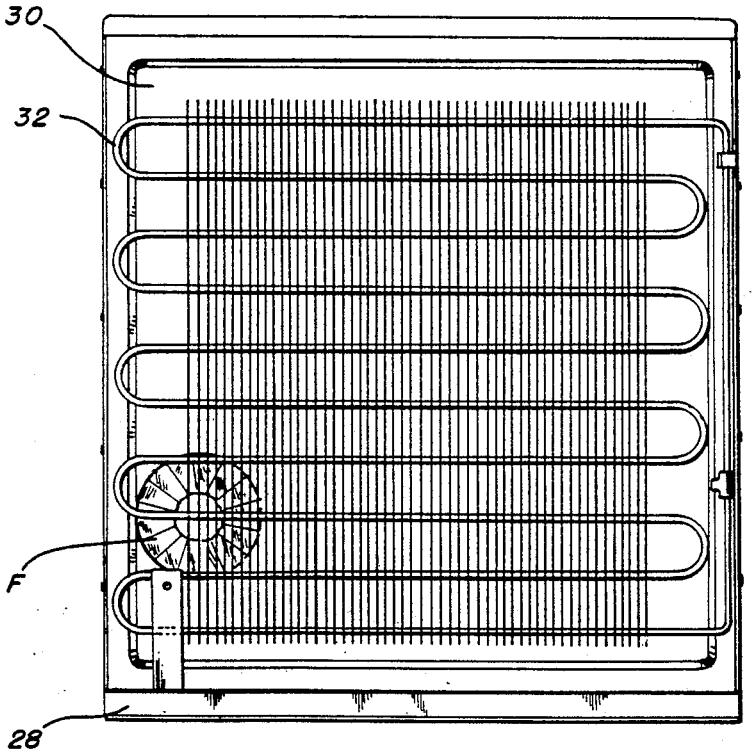
FIG. 4 is a back elevational view of the post-mix beverage dispenser unit of FIG. 1.
Figure 5:
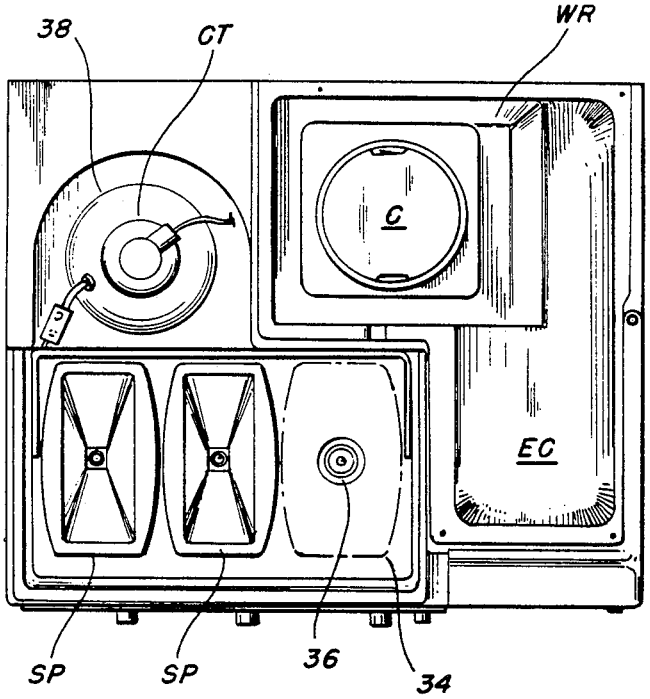
FIG. 5 is a top plan view of the post-mix beverage dispenser unit of FIG. 1 with the top access panels removed to illustrate the compartments for housing the respective component parts of the post-mix beverage dispenser system.
Figure 6:
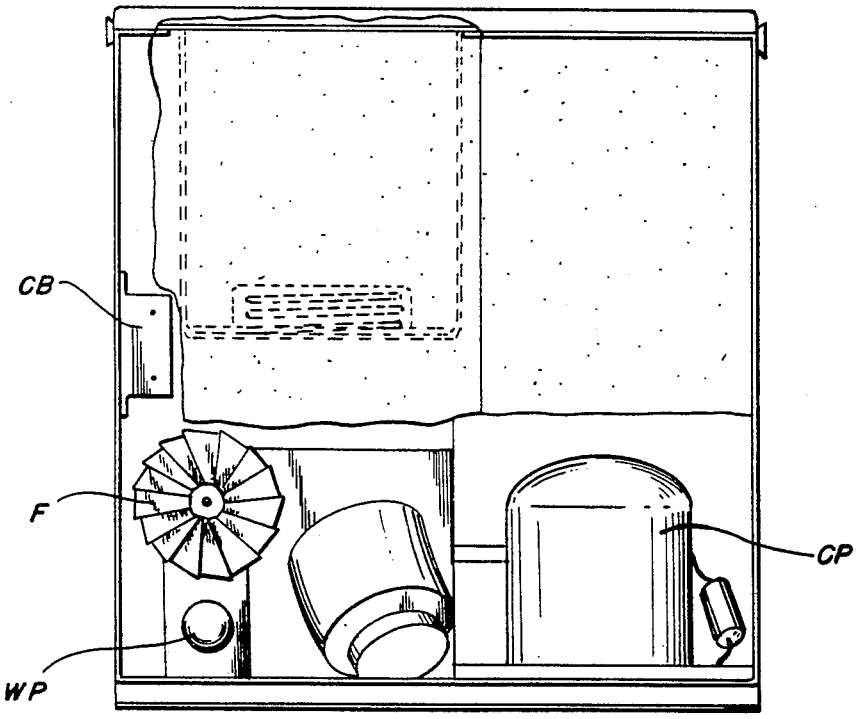
FIG. 6 is a rear elevational view of the dispenser unit of FIG. 1 with the rear panel removed.
Figure 7:
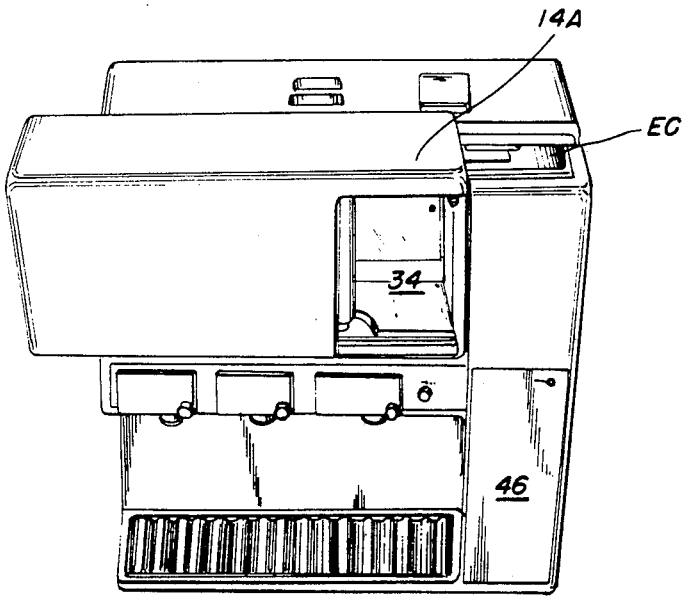
FIG. 7 is a front perspective view showing a front access panel of the cabinet of the dispenser unit of FIG. 1 slid to an open position to expose the water entrance chute of the present invention.

The cabinetry construction and the general arrangement of the components of the post-mix beverage dispenser unit of the present invention are illustrated in FIGS. 1 to 9. Referring to detail to these Figures, there is illustrated the post-mix beverage unit of the present invention generally designated 10, including a main cabinet portion 12 having front, back, side, top and bottom walls disposed at right angles to each other to provide a generally cubicle shape. A front access panel 14 is slidably mounted on the main cabinet portion 12 in suitable tracks to provide selective access to a water entrance chute EC and a syrup supply compartment 34. The front access panel 14 is so configured that it forms a flush corner of the final cabinet design in its closed position. That is, removable panel 14 has major surfaces parallel to the top, front and left side of the main cabinet portion 12 so that it wraps around and defines a corner of the overall cabinet surface of the unit in the closed position. As best illustrated in FIG. 7 and FIG. 1 in perspective, the front panel 14 is provided with an extension surface in the plane of the top wall of the main cabinet 12 which covers water entrance chute EC in the closed position and may be selectively removed to uncover the entrance chute EC in an open position. In this position illustrated in FIG. 7, the water reservoir WR illustrated in FIG. 5 can be manually filled with water from a pitcher by pouring water into entrance chute EC. However, it is advantageous to close off entrance chute EC from the atmosphere when water is not being introduced into the unit for sanitary reasons.

Figure 10:
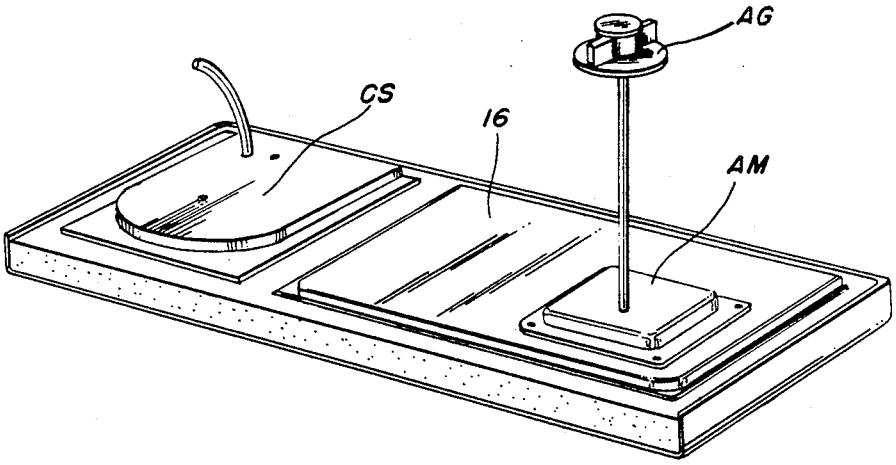
FIG. 10 is a bottom perspective view of a top access panel which covers the carbonator compartment and water reservoir section of the dispenser unit of the present invention.

A top access panel 16 is provided to cover both the water reservoir WR and carbonator compartment 38 juxtaposed near the back wall of the main cabinet portion 12. This access panel 16 is rectangular in shape and merely lifts off from the top of the unit by releasing latch member 16A when access to the water reservoir WR and carbonator compartment 38 is desired. As illustrated in FIG. 10, the top access panel 16 has an agitator blade AG depending therefrom coupled to an agitator motor secured with access panel 16 having a complimentary shape to the carbonator compartment 38 to thereby seal and insulate the carbonator compartment 38 when the rear access panel 16 is secured to the top of the cabinet 12.

The back of the main cabinet 12 is provided with a removable access panel 30 which substantially covers the entire rear wall of the cabinet 12 and has attached thereto a conventional refrigeration condenser 32 for the mechanical refrigeration system of the present invention. Removal of this rear access panel 30 and condenser 32 provides ready access to the water pump and refrigeration components of the present invention which will be described in more detail hereinafter with reference to FIG. 6.

Figure 9:
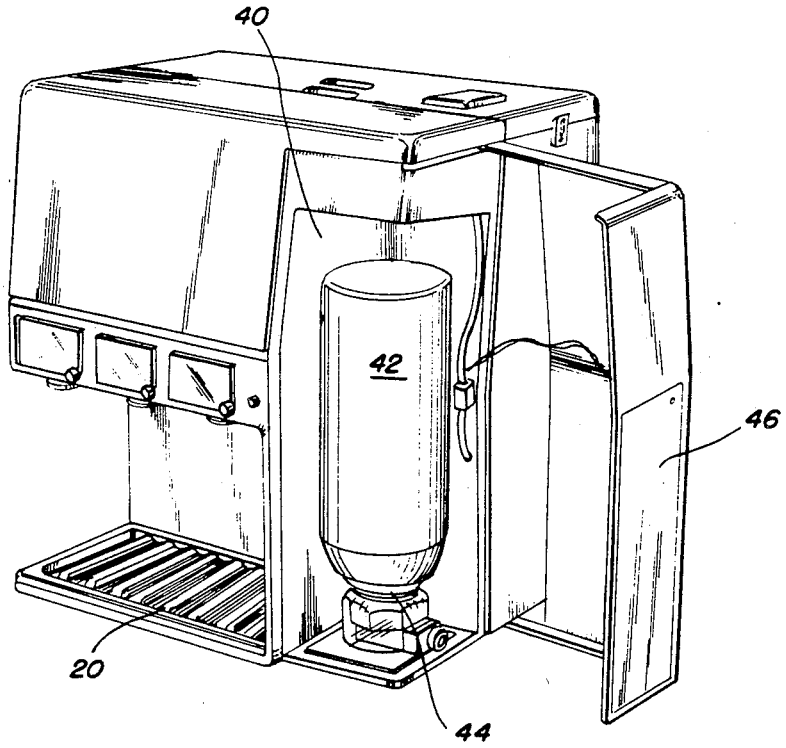
FIG. 9 is a front perspective view illustrating the $CO_2$ supply compartment of the dispenser cabinet of FIG. 1 in an open position.

An additional access panel 46 is provided in the lower right-hand corner of the dispenser unit of the present invention, as viewed in FIGS. 1 and 9. In the closed position, panel 46 comprises the lower right-hand corner of the dispenser unit cabinet and is hinged at its back edge to, in effect, form a door which provides access to a $CO_2$ compartment 40 for containing a $CO_2$ cylinder 42 and a $CO_2$ regulator valve assembly 44. That is, access panel 46 has a right angle configuration which conforms to the shape of the lower right-hand corner of the dispenser cabinet to close the $CO_2$ supply compartment which is a cut-out in one corner of cabinet 12.

Figure 8:
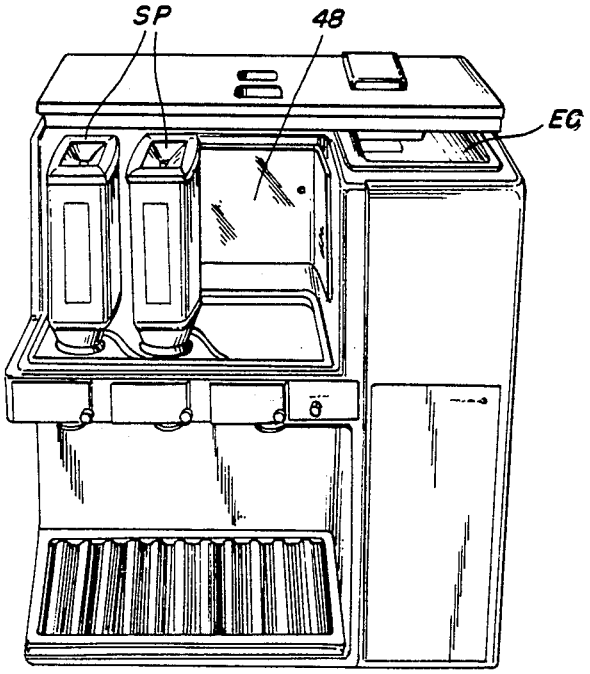
FIG. 8 is a front perspective view with the front access panel completely removed to uncover both the water entrance chute and syrup supply compartment of the present invention.

The unique combination of the access panels 14, 16 and 46 facilitates rapid set-up of the post-mix beverage system of the present invention and easy access for repair. With respect to set-up of the system, this may be achieved in the following manner. Front access panel 14 may be slid to a fully opened position, as illustrated in FIG. 8, and suitable syrup containers SP may be inverted, directing their discharge ends downwardly and plugged into sockets 36 (FIG. 5). Water may then be manually poured from a pitcher into water entrance chute EC whereby it flows down the chute into water reservoir WR. Front access panel 14 may then be closed to the fully closed position illustrated in FIG. 1. In the event that the dispenser unit had an adequate supply of syrup and only water need be added, the access panel 14 could be slid to the partially open position of FIG. 7, whereby only water entrance chute EC were exposed and water added as described above. The $CO_2$ cylinder 42 illustrated in FIG. 9 may then be added by inverting the $CO_2$ cylinder to direct the discharge opening downwardly and plugging the same into a socket provided on the top surface of $CO_2$ regulator valve assembly 44. Thus, it can be seen that the necessary ingredients to be supplied to the post-mix beverage dispenser can be supplied in a rapid and efficient manner without cumbersome connections by virtue of the unique cabinetry design of the present invention and the plug-in nature of both the syrup packages SP and $CO_2$ cylinder 42 of the present invention.

In further reference to the plug-in nature of the syrup packages SP and the $CO_2$ supply cylinder 42, the specific structure of the valve assemblies and associated containers to be used with the dispenser unit of the present invention are described in prior co-pending applications assigned to the same assignee as the present invention. For example, the specific dispensing valve assembly 18 and mixing nozzles 22 contemplated for use with the present invention is described in prior co-pending application Ser. No. 084,434 filed Oct. 12, 1979 to Jason K. Sedam and William R. Fuerst U.S. Pat. No. 4,306,667, issued Dec. 22, 1981. The specific socket for use in combination with the valve assembly 18 contemplated for use with the present invention is described in co-pending application Ser. No. 311,645, filed Oct. 15, 1981 to Jason K. Sedam which is now U.S. Pat. No. 4,426,019, issued Jan. 17, 1984. The specific $CO_2$ cylinder construction to be used for cylinder 42 and the associated $CO_2$ regulator valve socket and assembly to be used with the dispenser unit of the present invention is described in co-pending application Ser. No. 277,806, filed June 26, 1981 to Jason K. Sedam which is now U.S. Pat. No. 4,357,284, issued Nov. 2, 1982. The disclosures of each of these aforementioned co-pending applications are incorporated herein by reference.

The preferred embodiments of the syrup packages SP to be utilized with the present invention are described in U.S. Pat. No. 4,216,885 to Jason K Sedam, issued Aug. 12, 1980, and the particular shape of the package is disclosed 'in co-pending design application, Ser. No. 310,367, filed Oct. 9, 1981 to Jason K. Sedam and Simon J. Richter which is now U.S. Pat. No. Des. 273,768, issued May 8, 1984. As disclosed in the prior Sedam U.S. Pat. No. 4,216,885, the syrup package SP is provided with a flow control tube therein which is vented to the atmosphere through the bottom of the container after the container is plugged into socket 36. Containers SP are also provided with frangible seals or membranes over the discharge openings thereof and are punctured by a knife or cutting means of the type described in the co-pending application, Ser. No. 311,645, mentioned above.

The $CO_2$ cylinder 42 to be used with the dispenser unit of the present invention is of the type described in the aforementioned Sedam application Ser. No. 277,806 which is now U.S. Pat. No. 4,357,284, issued Nov. 2, 1982, which has a dip tube therein to facilitate the dispensing of $CO_2$ gas from the container in an inverted position such as that which occurs when the discharge end is plugged into a socket in the top of $CO_2$ regulator valve assembly 44.

Referring in further detail to FIGS. 5 and 9, it can be seen that the cabinetry construction of the present invention includes three component compartments accessible through the top wall of the cabinet, including the syrup compartment, water compartment and carbonator compartment and a $CO_2$ supply compartment 40 (FIG. 9) formed as a cut-out in the lower right-hand front corner of the dispenser cabinet. An additional compartment is provided in the bottom rear of the cabinet, as illustrated in FIG. 6, to house the components of the refrigeration system to be described hereinafter.

The main cabinet portion 12, as well as the various access panels in a preferred embodiment are made of injection molded plastic. Insulation may be provided within the unit and the access panels to increase the cooling efficiency. The injection molded plastic cabinet may be hot-stamped or otherwise decorated with suitable identifying logos, if desired.

The cabinet of the present invention is also provided with a conventional form of drip tray 20 disposed in an open recess below the syrup compartment and mixing nozzles 22. The cabinet also is provided with a single vertically adjustable front foot 26 centrally disposed under the front edge of the cabinet and a rear support bracket or leg 28 which extends along the entire back edge of the cabinet. This support arrangement facilitates adjustability and stability of the cabinet of the present invention.

As will be described in more detail hereinafter, a U-shaped cooling bracket 48 may be provided in the syrup supply compartment 34 as illustrated in FIG. 8. This bracket may be formed of any good heat conductor, and it wraps around the three syrup packages SP. As will be illustrated in more detail with reference to FIG. 11, a portion of the evaporator coil C disposed within the water reservoir WR may pass behind and in direct contact with cooling bracket 48 to assist in the cooling of the syrup within syrup packages SP.

Figure 11:
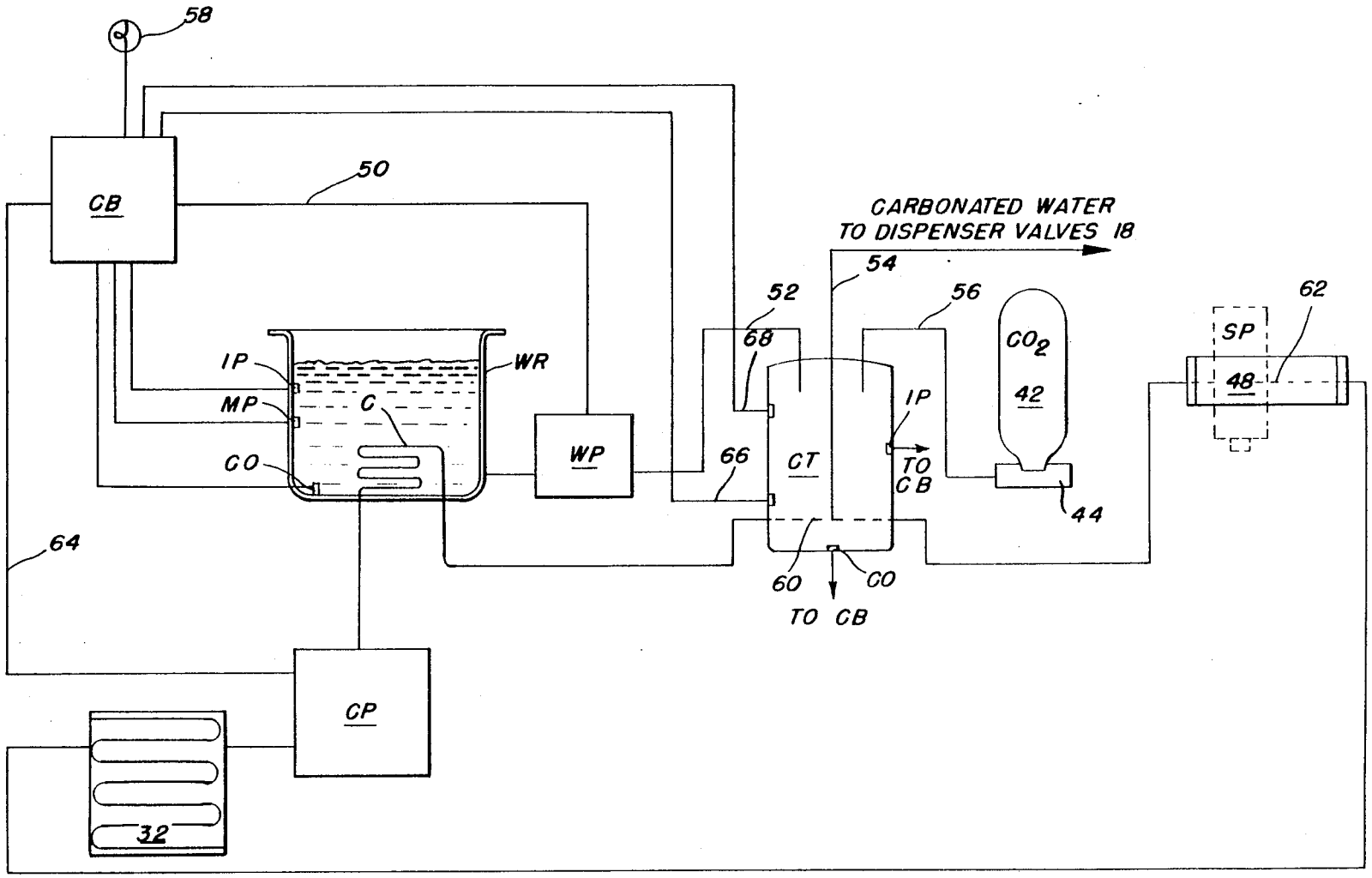
FIG. 11 is a schematic diagram of the mechanical refrigeration system of the present invention.

The arrangement of the components of the mechanical refrigeration system of a preferred embodiment of the present invention and other mechanical components not described hereinabove is illustrated in FIG. 6. The compressor of the refrigeration system is indicated as CP and is disposed directly below the carbonator compartment of the dispenser unit of the present invention. A circulating fan F is also provided and disposed directly below the water reservoir WR for exhausting hot air from the dispenser cabinet. The evaporator of the refrigeration system is not illustrated in FIG. 6, but can be viewed in the top plan view of FIG. 5 as being in the bottom of the water reservoir WR. A water pump WP is disposed in the cabinet just below the fan F. The water pump, as will become more fully apparent hereinafter with respect to FIG. 11, is provided to pump water from the water reservoir WR into the carbonator tank CT on demand. The electrical controls for operating the dispensing system of the present invention are housed in a box CB just above the fan F, as illustrated in FIG. 6.

Water Supply, Carbonation and Refrigeration Systems

The water supply, carbonation and refrigeration systems of the present invention are illustrated in the schematic diagram of FIG. 11. The water reservoir WR is connected to the carbonator tank CT through the water pump WP to pump water on demand from the reservoir to the carbonator tank under the supervision of a plurality of probes IP, MP and CO and suitable electrical controls within box CB. That is, when power is turned on, pump WP will normally pump water from reservoir WR into carbonator tank CT. However, if the water level falls below the minimum level of probe MP, the electrical circuitry provided within control box CB will turn pump WP off and indicator light 58 on, which signals the need to refill the water reservoir WR.

Probes IP in water reservoir tank WR and carbonator tank CT sense the build-up of ice on the walls thereof, and when it exceeds a predetermined thickness whereby it covers probes IP, compressor CP is turned off via control box CB and control Line 64. Probes CO in water reservoir tank WR and carbonator tank CT are merely the common or ground connections for the circuitry of both probes IP and MP.

Carbonator tank CT also has an additional pair of probes 66 and 68 to initiate or terminate the operation of water pump WP, depending on the level of water present in carbonator tank CT. That is, when the water level drops below probe 66, pump WP turns on to fill the carbonator tank, and when it reaches a maximum level at the position of probe 68, a signal is generated in the control circuitry within box CB via line 50 to turn the water pump WP off. Thus, the respective probes in the water reservoir WR and carbonator tank CT are all connected through the electrical control circuitry in control box CB to either turn the water pump WP on and off, or the refrigeration compressor CP via line 64.

With water present in carbonator tank CT, it operates in a conventional manner by mixing water from line 52 and $CO_2$ gas from line 56 within the tank CT and dispensing carbonated water through outlet line 54 to the dispenser valve assembly 18 wherein it is mixed with syrup from the syrup packages SP.

As further illustrated in FIG. 11, the mechanical refrigeration system includes a compressor CP, an evaporator C, and a condenser 32 connected in a closed refrigeration loop. The evaporator C is disposed in contact with the water reservoir WR to directly chill the water to be pumped to the carbonator. As illustrated, a portion of the evaporator C, namely portion 60, wraps around the carbonator tank CT to cool the same. In addition, another portion 62 of evaporator C may pass directly behind and in direct contact with cooling bracket 48 which surrounds syrup packages SP on three sides to cool the contents of those packages. Thus, the mechanical refrigeration system of the present invention may be in heat transfer relationship with all of the essential components of the post-mix beverage to be dispensed prior to the mixing of those components within mixing nozzles 22. This assures that a post-mix beverage is dispensed at a controllable and suitable temperature into cups or containers resting on drip tray 20.

In an alternative embodiment, the heat transfer relationship achieved by the refrigeration system of FIG. 11 and, more specifically, the portions 60 and 62 of the evaporator coil C in conjunction with the heat transfer bracket 48, may be accomplished by use of a thermoelectric cooling system in combination with a specially designed cold plate therefor which makes a similar type of contact with the carbonator tank and syrup packages. This embodiment of a thermoelectric refrigeration system is illustrated in FIGS. 12A and 12B.

Figure 12A:
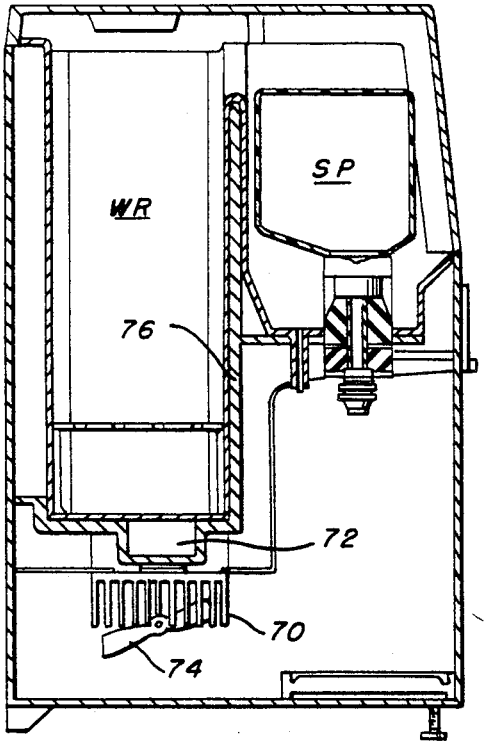
FIGS. 12A and 12B are cross-sectional views of a portion of an alternate embodiment of the refrigeration system of the present invention wherein a thermoelectric cooling element may be used.

Referring to FIG. 12A, there is generally illustrated a thermoelectric module 72, having associated therewith a cold plate 76. Cold plate 76 is so configured that it wraps around water reservoir WR and the syrup supply compartment which houses syrup packages SP. Thus, both the water reservoir WR and the syrup packages SP are directly cooled by the cold plate 76. Also illustrated in FIG. 12A is a heat sink 70 on the bottom of the thermoelectric module 72 and an associated fan 74 for removing heat from a dispenser cabinet.

Figure 12B:
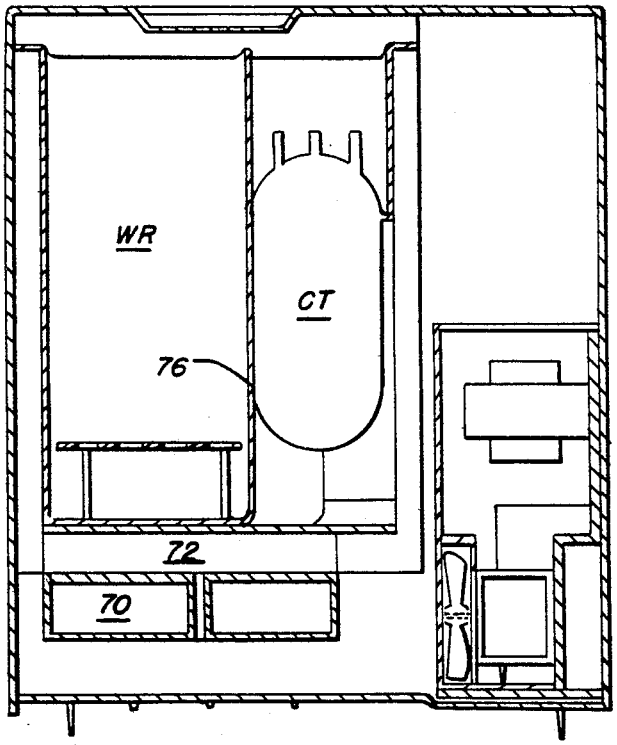

Referring to FIG. 12B, there is illustrated a carbonator tank CT, which is also juxtaposed to water reservoir WR and in direct contact with a portion of cold plate 76. Thus, carbonator tank CT is also in a heat transferring relationship with cold plate 76 and is directly cooled thereby. Accordingly, the dispenser unit has three juxtaposed compartments housing the water reservoir, syrup packages and carbonator tank, respectively, which are all in direct heat transfer relationship with cold plate 76. Thus, as in the mechanical refrigeration system of the present invention, the water reservoir, carbonator tank and syrup packages are all directly cooled by the refrigeration system to provide a suitably chilled post-mix beverage.

It should be understood that a preferred embodiment of the dispenser cabinetry and system components of the beverage dispenser of the present invention have been described herein, but that modifications may be made as would occur to one of ordinary skill in the art without departing from the spirit and scope of the present invention.

For example, the arrangement of the respective compartments of the cabinetry may be modified within the spirit and scope of the present invention. The terminology of front, back, side and bottom walls is used for descriptive purposes of the preferred embodiment only to define the relative locations of the component parts as illustrated in the drawings, it being recognized that the cabinet may be rotated making the cabinet front and back the sides and vice versa. In addition, the cabinet access panels may be modified slightly within the spirit of the present invention. For example, common panels could be used to cover adjacent component compartments to reduce the number of panels.

What is claimed is:

1. A post-mix beverage dispensing system comprising:

a main cabinet portion having top, front, back, side and bottom walls with open compartments formed therein housing various components of the post-mix beverage system, said compartments including:
- a water supply compartment for housing a water reservoir and an entrance chute therefor extending to said front wall,
- a carbonator compartment for housing a carbonator tank,
- a syrup supply compartment for housing replaceable syrup containers adjacent said front wall, and
- a $CO_2$ supply compartment for housing a $CO_2$ cylinder adjacent said front wall;

said top wall of said main cabinet having openings therein providing access to said water reservoir, entrance chute, carbonator compartment, and said syrup supply compartment;

said front wall also having openings therein providing access to said syrup compartment and said $CO_2$ supply compartment;

a first access panel normally covering the openings in said front and top walls providing access to said syrup supply compartment;

a second access panel normally covering said openings in said top wall providing access to said water compartment and said carbonator compartment;

a third access panel at least covering the opening in said front wall providing access to said $CO_2$ supply compartment, said third access panel being movable to uncover said opening in said front wall to provide access to said $CO_2$ supply compartment;

water supply conduit means connecting said water reservoir and said carbonator tank;

pump means for pumping water from said water reservoir to said carbonator tank;

$CO_2$ supply conduit means connecting said $CO_2$ cylinder to said carbonator tank; and a refrigeration system including,
- a compressor,
- a condensor, and
- an evaporator coil, said evaporator coil having a main portion disposed in contact with said water reservoir for cooling said water, a second portion in heat transfer relationship with said carbonator tank, and a third portion in heat transfer relationship with said replaceable syrup containers.

2. A cabinet construction for a post-mix beverage dispenser unit comprising:

a main cabinet portion having top, front, back, side and bottom walls with open compartments formed therein for housing various components of the post-mix beverage dispenser, said compartments including:

a water supply compartment for housing a water reservoir and an entrance chute therefor extending to said front wall, a carbonator compartment for housing a carbonator tank, a syrup supply compartment for housing replaceable syrup containers adjacent said front wall, and a $CO_2$ supply compartment for housing a $CO_2$ cylinder adjacent said front wall;

said top wall of said main cabinet having openings therein providing access to said water reservoir, entrance chute, carbonator compartment, and said syrup supply compartment;

said front wall also having openings therein providing access to said syrup supply compartment and said $CO_2$ supply compartment;

a first access panel at least covering the opening in said front wall providing access to said syrup supply compartment;

a second removable access panel normally covering said openings in said top wall providing access to said water compartment and said carbonator compartment; and a third access panel at least covering the opening in said front wall providing access to said $CO_2$ supply compartment, said third access panel being movable to uncover said opening in said front wall to provide access to said $CO_2$ supply compartment.

3. The invention defined in claim 1 or 2, wherein said first access panel means also normally covers said entrance chute and is slidably mounted on said main cabinet portion, and when slid from said normal covering positions, first uncovers said entrance chute and then said syrup compartment.

4. The invention defined in claim 3, wherein said first access panel has a wrap-around portion with surfaces parallel to the corner defined by said top and front walls and is slidable in tracks provided in said top and front walls.

5. The invention defined in claim 4, wherein said first access panel means has an extension from said wrap-around portion in the plane of said top wall which covers said entrance chute.

6. The invention defined in claim 1 or 2, wherein said second removable access panel is flat with major surfaces thereof parallel to said top wall and latch means are provided for securing the same to said top wall.

7. The invention defined in claim 1 or 2, wherein said $CO_2$ supply compartment is a cut-out of a vertical corner of said cabinet portion between said front wall and one of said side walls and said third access panel means comprises a hinged door having major planar surfaces at right angles to each other, filling the cut-out of said vertical corner in a closed position.

8. The invention defined in claims 1 or 2, further comprising a fourth removable access panel normally covering the entire back wall of said main cabinet portion.

9. The post-mix beverage dispensing system of claim 1, further comprising heat transfer bracket means in direct contact with said third portion of said evaportor coil, said heat transfer bracket means partially enclosing the sidewalls of said at least one syrup container providing heat transfer surface portions in close proximity to opposed surfaces of the sidewalls of said syrup container.

10. A cabinet construction for a post-mix beverage dispenser unit comprising:

a main cabinet portion having top, front, back, side and bottom walls with open compartments formed therein for housing various components of the post-mix beverage dispenser, said compartments including:

a water supply compartment for housing a water reservoir and an entrance chute therefor extending to said front wall, a carbonator compartment for housing a carbonator tank, a syrup supply compartment including upwardly facing sockets for receiving the discharge end of replaceable gravity-feed syrup containers adjacent said front wall, and a $CO_2$ supply compartment including an upwardly facing socket for receiving the discharge end of a $CO_2$ cylinder adjacent said front wall;

said front wall having openings therein providing access to said syrup supply compartment and said $CO_2$ supply compartment; and access panel means at least covering the openings in said front wall, said access panel means providing access to said syrup supply compartment, $CO_2$ supply compartment and said entrance chute.

* * * * *